US011761072B2

(12) United States Patent
Kim

(10) Patent No.: US 11,761,072 B2
(45) Date of Patent: Sep. 19, 2023

(54) MG-COMPRISING HOT-DIP GALVANIZED STEEL SHEET MANUFACTURING METHOD AND MANUFACTURING APPARATUS

(71) Applicant: M.E.C CO., LTD, Gwangyang-si (KR)

(72) Inventor: Sang-Ho Kim, Gwangyang-si (KR)

(73) Assignee: M.E.C CO., LTD, Gwangyang-si (KR)

( * ) Notice: Subject to any disclaimer, the term of this patent is extended or adjusted under 35 U.S.C. 154(b) by 0 days.

(21) Appl. No.: 17/269,308

(22) PCT Filed: Dec. 11, 2018

(86) PCT No.: PCT/KR2018/015644
§ 371 (c)(1),
(2) Date: Feb. 18, 2021

(87) PCT Pub. No.: WO2020/040360
PCT Pub. Date: Feb. 27, 2020

(65) Prior Publication Data

US 2021/0214830 A1 Jul. 15, 2021

(30) Foreign Application Priority Data

Aug. 24, 2018 (KR) ..... 10-2018-0098941

(51) Int. Cl.
*C23C 2/20* (2006.01)
*C23C 2/26* (2006.01)
(Continued)

(52) U.S. Cl.
CPC ..... *C23C 2/06* (2013.01); *C23C 2/20* (2013.01); *C23C 2/26* (2013.01); *C23C 2/40* (2013.01)

(58) Field of Classification Search
CPC .. C23C 2/003; C23C 2/02; C23C 2/06; C23C 2/18; C23C 2/20; C23C 2/26; C23C 2/40
See application file for complete search history.

(56) References Cited

U.S. PATENT DOCUMENTS 3,505,043 A 4/1970 Lee et al.
3,535,168 A * 10/1970 Thompson ..... C23C 22/83 148/265
(Continued)

FOREIGN PATENT DOCUMENTS

JP 02263970 A * 10/1990
JP 05320854 A * 12/1993
(Continued)

*Primary Examiner* — Alexander M Weddle
(74) *Attorney, Agent, or Firm* — LEX IP MEISTER, PLLC

(57) ABSTRACT

The present invention relates to an apparatus and a method of manufacturing a hot dipped galvanized steel sheet that is excellent in corrosion resistance and has no linear defects, thereby being available for automobile bodies, household appliances, construction materials, and the like which need aesthetic surfaces. The apparatus for manufacturing a hot dipped galvanized steel sheet includes: a plating pot filled with a galvanizing bath for coating of a steel sheet; a sink roll; a wiping device adjusting the thickness of the coating on the steel sheet; a top roll; an oxidation process chamber; and an air cooling device. According to the present invention, after an excess molten coating solution attached to the steel sheet is evenly removed, an oxide film is made to be 0.1 μm to 0.3 μm thick before a coating layer starts to solidify. Thus, linear defects can be prevented.

7 Claims, 5 Drawing Sheets

Diagram showing oxidation process chamber of present invention (8) Steel sheet
(9) Oxidation process chamber
(10) Tungsten wire supporter
(11) High voltage generator
(12) Tungsten wire
(13) Solution spraying nozzle

(51) Int. Cl.
*C23C 2/40* (2006.01)
*C23C 2/06* (2006.01)

(56) References Cited

U.S. PATENT DOCUMENTS 6,235,410 B1 * 5/2001 Komatsu ..... C23C 2/26
427/435
8,592,049 B2 11/2013 Honda et al.

FOREIGN PATENT DOCUMENTS

| | | | |
|---|---|---|---|
| JP | H05-320854 | A | 12/1993 |
| JP | 2010-174262 | A | 8/2010 |
| KR | 10-2002-0053633 | A | 7/2002 |
| KR | 10-0324893 | B1 | 8/2002 |
| KR | 10-2008-0080416 | A | 9/2008 |
| KR | 10-2015-0073036 | A | 6/2015 |

* cited by examiner

【Fig. 1】 -- Prior Art --
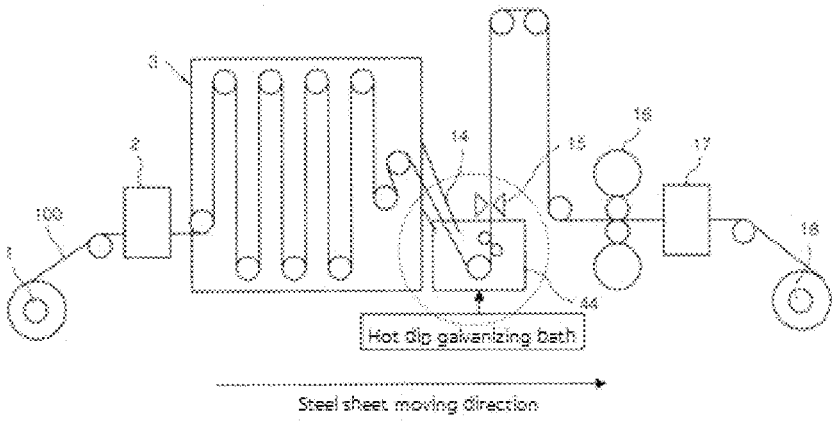
【Fig. 2】
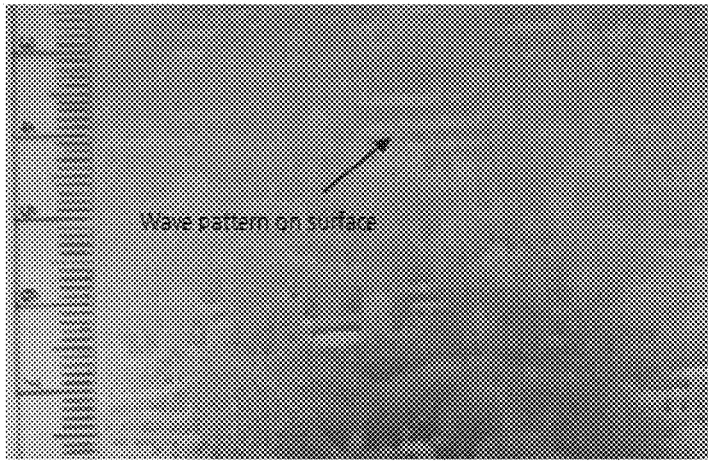

【Fig. 3】
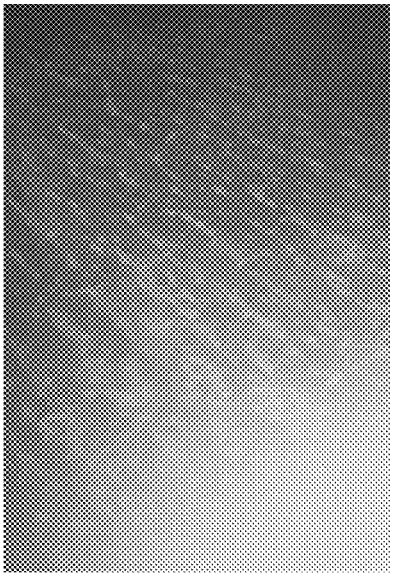
【Fig. 4】
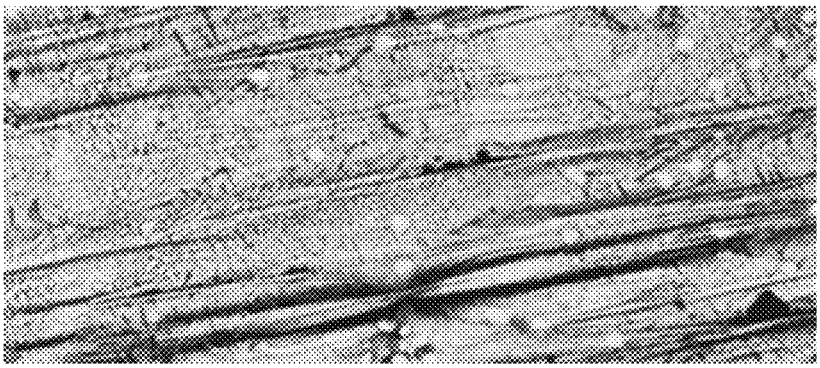

【Fig. 5】
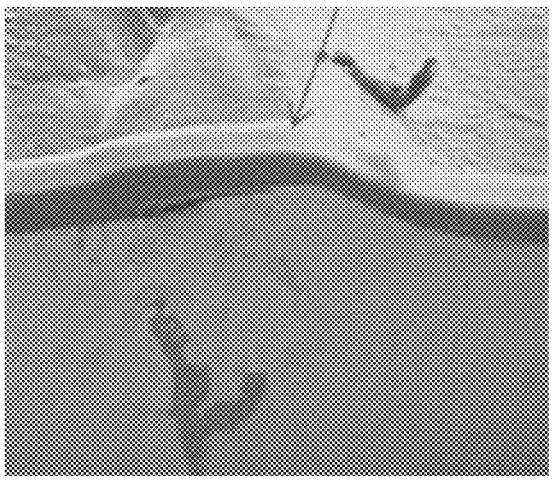
【Fig. 6】
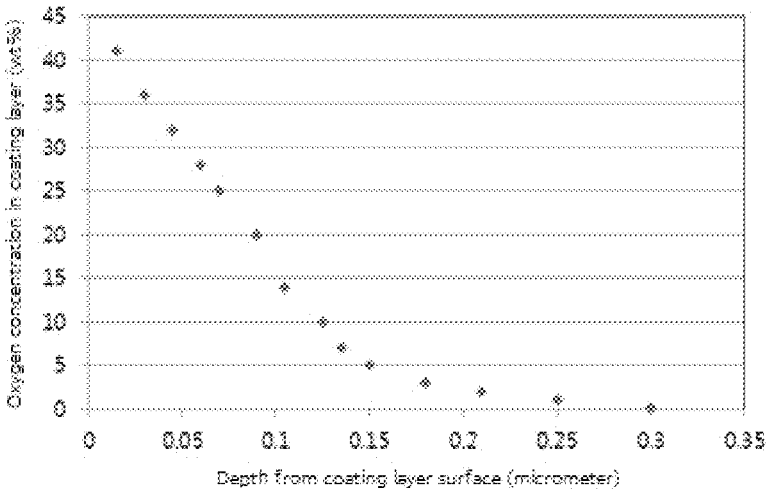

【Fig. 7】
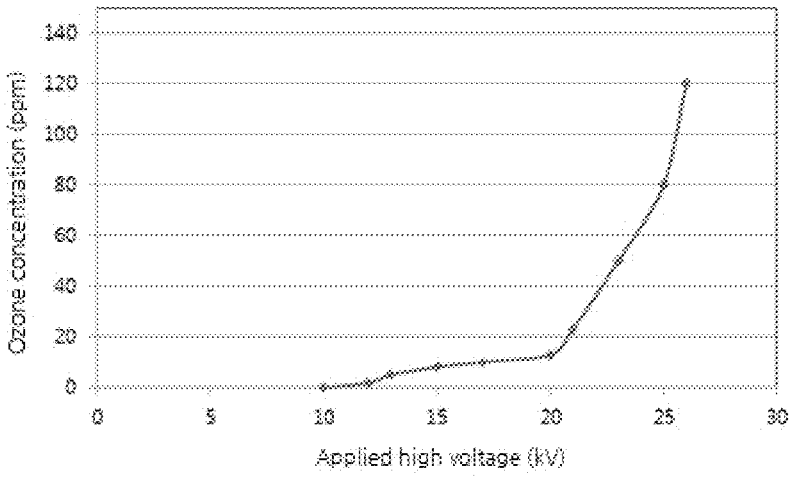
【Fig. 8】
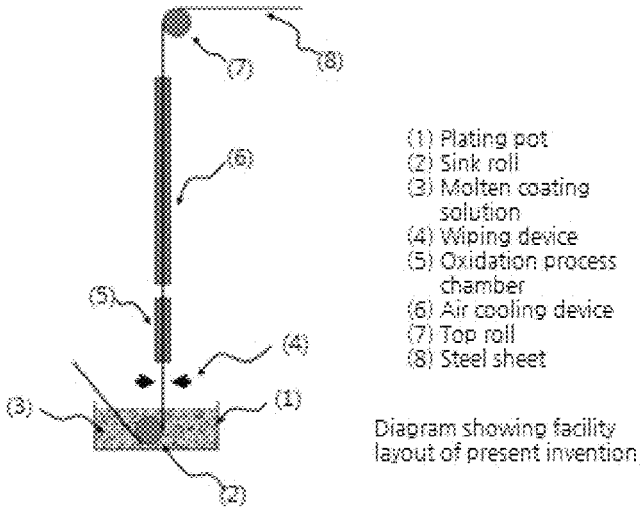
Diagram showing facility layout of present invention 【Fig. 9】
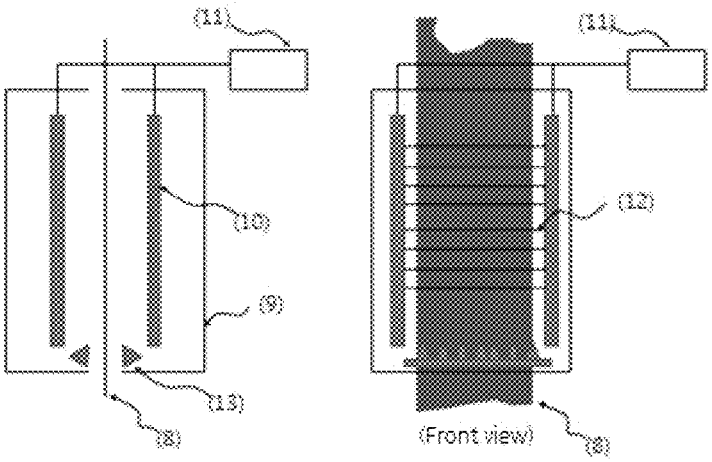
Diagram showing oxidation process chamber of present invention
(8) Steel sheet
(9) Oxidation process chamber
(10) Tungsten wire supporter
(11) High voltage generator
(12) Tungsten wire
(13) Solution spraying nozzle

MG-COMPRISING HOT-DIP GALVANIZED STEEL SHEET MANUFACTURING METHOD AND MANUFACTURING APPARATUS

BACKGROUND OF THE INVENTION

Field of the Invention

The present invention relates to a method of manufacturing a strip-shaped hot dipped Zn—Al—Mg coated steel sheet. More particularly, the present invention relates to an apparatus and a method of manufacturing a hot dipped galvanized steel sheet that is excellent in corrosion resistance and has no linear defects, thereby being available for automobile bodies, household appliances, construction materials, and the like which need aesthetic surfaces.

Description of the Related Art

Galvanized steel sheets, which are manufactured by using a hot dip galvanizing bath containing an appropriate amount of Mg in Zn, have good corrosion resistance and are used for steel sheets for automobiles as well as for construction materials. Mg is a metal easily oxidized compared to Zn or Al widely used as a hot-dip coating material, and it is known that Mg improves corrosion resistance by forming dense corrosion products when the coating layer is corroded.

Ever since U.S. Pat. No. 3,505,043 has proposed a hot dipped Zn—Al—Mg coated steel sheet excellent in corrosion resistance which is manufactured by using a hot dip galvanizing bath composed of Al: 3 wt % to 17 wt % and Mg: 1 wt % to 5 wt % with the balance being Zn, many known techniques of compounding various kinds of additive elements or regulating manufacturing conditions for a basic bath composition have been proposed.

A conventional apparatus for manufacturing a hot dipped galvanized steel sheet is illustrated in FIG. 1. A process of manufacturing a hot dipped galvanized steel sheet will be described with reference to FIG. 1. A cold-rolled coil is mounted on a pay-off reel 1, and front and rear end coils are welded by a welder 2. Then, heat treatment is performed in an annealing furnace 3 to eliminate residual stress imparted to the steel sheet during cold rolling. A steel sheet 100 obtained after completion of the annealing is kept at a temperature suitable for a galvanizing process, and then enters a hot dip galvanizing bath 44. A snout 14 is provided to prevent surface oxidation caused by exposing the steel sheet heat-treated at high temperature to the atmosphere. The snout may be filled with inert gases supplied via a gas supply pipe to prevent coating defects which may be caused by surface oxidization. The steel sheet passes the snout and the hot dip galvanizing bath, and is adjusted by an air knife 15 to a predetermined coating amount desired by the customer. After completion of the coating amount adjusting process, the galvanized steel sheet passes a skin pass mill 16 to be subjected to have proper surface roughness and to be modified in shape. Then, the galvanized steel sheet is cut by a cutter 17 and wound by a tension reel 18, thereby obtaining a final product.

Here, when the air knife performs gas wiping with air as a wiping gas to adjust the coating amount, irregularities occur in the thickness of the coating layer as illustrated in FIG. 2, resulting in wave-patterned ripple defects.

This type of defect is a phenomenon in which thickness variation of the coating layer is extremely large, and occurs because the wiping process of scraping off excess molten metal to adjust the molten metal adhering to a surface of the steel sheet to a desired coating amount is performed unevenly. This is related to the phenomenon that when the air is used, the viscosity of the molten metal increases during the wiping, and thus, the excess amount of molten metal is scraped off unevenly. It is presumed that a molten coating solution is oxidized by the air, and thus the viscosity of the molten coating solution increases.

A technique of using nitrogen gas instead of air as a wiping gas has been proposed to prevent the occurrence of wave-patterned defects.

When wiping with nitrogen in manufacturing a high corrosion resistant hot dip galvanized steel sheet containing Mg, wave-patterned defect is prevented, but linear stripes extending on the surface of the steel sheet as illustrated in FIG. 3 are likely to occur.

These linear stripes do not occur on hot dip galvanized (GI coated) steel sheet or on Zn—Al alloy coated steel sheet, which does not containing Mg, but only on a coating layer containing Mg. In addition, no linear stripe defect occurs in air wiping, but only occurs in nitrogen wiping. It is a natural that the nitrogen wiping is less oxidizing the coating solution than air wiping.

Therefore, it is possible to assume that causes of occurrence of linear stripes are the metallurgical change of the solidification reaction and the interaction of the oxide film according to the addition of Mg in the coating solution.

Korean Patent No. 10-0324893 discloses an invention that prevents linear defects. The above related art relates to a method of making an oxygen concentration in a sealed box, which is installed in a coating tub, 8 vol % or less when coating is performed in a coating bath composed of 1.0 wt % to 4.0 wt % of Mg. The related art is intended to minimize air entrainment in nitrogen wiping to form a uniform oxide film on the surface, thereby preventing linear stripe defects.

However, according to a technique of installing a sealed box, an additional sealed box is required to be installed above a plating pot. In addition, core facilities of hot dip galvanizing such as a gas wiping device and pot rolls are present inside the sealed box so that when a problem occurs in manufacture of galvanized steel sheets, it is not easy to solve the problem immediately. In some cases, the problem can be solved after disassembling the sealed box, which is very troublesome, and thus productivity is reduced. For example, when increasing the gas wiping pressure to perform thin coating, zinc scattering occurs in the sealed box. In addition, defects occur when the blown zinc clogs a discharge port through which gas is discharged.

Documents of Related Art (Patent Document 1) Korean Patent No. 10-0324893.

SUMMARY OF THE INVENTION

Accordingly, the present invention has been made keeping in mind the above problems occurring in the related art, and an objective of the present invention is to provide an apparatus and a method of manufacturing a hot dipped galvanized (Zn—Al—Mg coated) steel sheet, the apparatus and the method enabling manufacturing of a hot dipped galvanized steel sheet free from linear stripe defects while performing a conventional nitrogen gas wiping, facilitating of a repair of defective equipment, and preventing discharge ports of nozzles from clogging, which may occur due to zinc scattering.

In order to achieve the above objective, the present invention provides an apparatus for manufacturing a hot dipped galvanized steel sheet containing Mg, the apparatus including:

a plating pot 1 filled with a galvanizing bath 3 for coating of a steel sheet 8; a sink roll 2 turning the introduced steel sheet upward; a wiping device 4 adjusting a thickness of the coating on the steel sheet; and a top roll 7.

An oxidation process chamber 5 in which the steel sheet passing the wiping device 4 is oxidized and an air cooling device 6 cooling the oxidized steel sheet are provided between the wiping device 4 and the top roll 7.

The oxidation process chamber 5 may include: a box-shaped chamber main body 9 through which the steel sheet passes a central portion of the main body 9; and an ozone generator provided to face a front surface and a back surface of the steel sheet passing through the central portion of the chamber main body 9.

The ozone generator may include: multiple tungsten wires extending in the width direction of the steel sheet and facing the front surface and the back surface of the steel sheet passing through the central portion of the chamber main body 9; tungsten wire supporters 10 supporting opposite ends of the multiple tungsten wires 12; and a high voltage generator 11 applying a high voltage to the tungsten wires.

In addition, the ozone generator may include: multiple hydrogen peroxide solution spraying nozzles 13 provided in a width direction and facing the front surface and the back surface of the steel sheet passing through the central portion of the chamber main body 9.

The oxidation process chamber 5 may be provided with both a corona discharge ozone generator and the hydrogen peroxide solution spraying nozzles.

In order to achieve another objective, the present invention provides a method of manufacturing a hot dipped galvanized steel sheet containing Mg, the method including:

adjusting a coating amount by an air knife after a steel sheet is immersed in and removed from a galvanizing bath of a plating pot by passing a sink roll; air-cooling the galvanized steel sheet having the adjusted coating thereon by using a cooling device; and passing the cooled galvanized steel sheet through a top roll. Between the adjusting of the coating amount and the air-cooling of the galvanized steel sheet, the method further include: forming an oxide film by oxidizing the galvanized steel sheet using an ozone generator.

At the forming of the oxide film, the ozone generator may be a corona discharge ozone generator. In addition, at the forming of the oxide film, the ozone generator may be an ozone generator spraying an aqueous solution containing hydrogen peroxide.

The forming of the oxide film may be performed for 0.5 seconds to 1.5 seconds under a condition in which a temperature at which the steel sheet is immersed is 385° C. to 410° C., a temperature at which the steel sheet is removed is 380° C. to 400° C., and an ozone concentration in a chamber is 1 ppm to 100 ppm.

The galvanizing bath may have a temperature of 440° C. to 460° C. The steel sheet may be immersed in the galvanizing bath at a temperature of 410° C. to 470° C. The air knife may use nitrogen gas. The steel sheet may have a temperature of 410° C. to 460° C. after performed with air wiping, and the steel sheet may have a temperature of 300° C. or below when reaching the top roll after passing through the cooling device.

The oxide film may be 0.1 μm to 0.3 μm thick.

The aqueous solution may contain 0.01% to 1% hydrogen peroxide.

According to the present invention, after an excess molten coating solution attached to a surface of a steel sheet is evenly removed, an oxide film is made to be 0.1 μm to 0.3 μm thick before a coating layer starts to solidify. Thus, even when nitrogen wiping is performed, linear defects can be prevented. In addition, a conventional sealed box is not provided so that it is possible to facilitate a repair of defective equipment and to prevent discharge ports of nozzles from clogging, which may occur due to zinc scattering.

BRIEF DESCRIPTION OF THE DRAWINGS

The above and other objects, features, and other advantages of the present invention will be more clearly understood from the following detailed description when taken in conjunction with the accompanying drawings, in which:

FIG. 1 is a schematic view illustrating a conventional apparatus for manufacturing a hot dipped galvanized steel sheet according to the related art;

FIG. 2 is a photograph illustrating wave-patterned defects generated on a surface of a hot dipped Zn—Al—Mg alloy coated steel sheet manufactured by conventional nitrogen wiping;

FIG. 3 is a photograph illustrating an enlarged view of a surface of a conventional linear defect portion observed with an electron microscope;

FIG. 4 is a photograph illustrating an enlarged view of a surface of a linear defect portion observed with an electron microscope according to the present invention;

FIG. 5 is a photograph illustrating an enlarged view of a cross section of the linear defect portion observed with an electron microscope according to the present invention;

FIG. 6 is a graph of an example of measurement of oxide thickness on a coating surface using a glow discharge mass spectrometer according to the present invention;

FIG. 7 is a graph of an example of measurement of oxygen concentration in a cooling chamber depending on a value of high voltage according to the present invention;

FIG. 8 is a schematic view illustrating an apparatus for manufacturing a hot dipped galvanized steel sheet according to the present invention; and FIG. 9 is a front view and a side view of an oxidation process chamber according to the present invention, respectively.

DETAILED DESCRIPTION OF THE INVENTION

Hereinbelow, an embodiment of the present invention will be described in detail with reference to accompanying drawings.

An apparatus for manufacturing a hot dipped galvanized steel sheet according to the present invention is illustrated in FIG. 8. Referring to FIG. 8, the apparatus for manufacturing a hot dipped galvanized steel sheet includes: a plating pot 1 filled with a galvanizing bath 3 for coating of a steel sheet 8; a sink roll 2 turning the introduced steel sheet upward; a wiping device 4 adjusting the thickness of the coating on the steel sheet; an oxidation process chamber 5 in which the steel sheet passed the wiping device is oxidized; an air cooling device 6 cooling the oxidized steel sheet; and a top roll 7.

FIG. 9 is a front view and a side view of the oxidation process chamber according to the present invention, respectively. Referring to FIG. 9, the oxidation process chamber 5 includes: a box-shaped chamber main body 9 through which the steel sheet passes a central portion of the main body 9; and a corona discharge ozone generator provided to face a front surface and a back surface of the steel sheet passing through the central portion of the chamber main body 9.

Specifically, the corona discharge ozone generator includes: multiple tungsten wires 12 extending in the width direction of the steel sheet and facing the front surface and the back surface of the steel sheet passing through the central portion of the chamber main body 9; tungsten wire supporters 10 supporting opposite ends of the multiple tungsten wires 12; and a high voltage generator 11 applying a high voltage to the tungsten wires.

In addition, multiple solution spraying nozzles 13 are provided in the width direction at a lower portion of the ozone generator in a manner facing the front surface and the back surface of the steel sheet passing through the central portion of the chamber main body 9.

Here, the corona discharge ozone generator and the solution spraying nozzles may be provided together or may be separately provided and used individually.

In general, Zn—Al—Mg alloy hot dip galvanizing is performed such that the steel sheet passes the plating pot at a temperature of 440° C. to 460° C. and is gas wiped to remove excess coating solution attached to the surface of the steel sheet and to adjust to a desired coating amount. Thereafter, the steel sheet is cooled to solidify the coating layer and kept being cooled so that the steel sheet is at a temperature of 300° C. or below when passing the top roll.

Linear defects are not observed in the molten state of the coating layer, but appear after the end of solidification and generally visible. From this, linear defects are presumed to form when solidification proceeds. FIG. 4 is an example of a surface of a coating layer having linear defects observed with an electron microscope. The surface of the coating layer has wrinkles in a linear form, and when a cross section of the coating layer in which the line-shaped wrinkles are formed is observed with an electron microscope, the wrinkle height is as fine as about 0.2 μm as illustrated in FIG. 5. In other words, linear defects are defects in the surface of the coating layer which appear as lines in which wrinkles or curved lines are connected with each other due to solidification.

The present inventors have found that no line defect occurs when a surface oxide film on the coating layer is 0.1 μm to 0.3 μm thick with respect to the molten metal containing Mg. Considering that the height difference of the wrinkles of linear defects is 0.2 μm, it is possible to prevent the occurrence of linear defects when the thickness of the surface oxide film proposed in the present invention is 50% to 150% of the wrinkle height formed by linear defects.

The reason why no linear defect occurs when the surface oxide film is 0.1 μm to 0.3 μm thick by the surface oxidation is unclear, but it is presumed as follows.

The surface oxide film starts to be formed from the wiping step, and when the thickness of the oxide film reaches a predetermined thickness, the oxide film blocks the contact between the molten metal and the air. After the oxide film is formed, solidification of the coating solution under the oxide film proceeds. The solidification of the coating layer progresses by the growth of metal phases varying depending on temperature interval. As solidification proceeds, the metal phases grow in the coating layer in the molten state so that a flow of fine molten metal occurs, and the oxide film formed on the coating surface moves by this flow whereby it is presumed that line defects having a height difference of about 0.2 μm occur.

Considering that no linear defect occurs in air wiping and a thicker oxide layer is formed in air wiping compared with nitrogen wiping, it can be assumed that the thicker the oxide film, the less the effect of the flow and the tendency of linear defects occurring decreases.

According to an experiment, no linear defect occurred in the case when the oxide film was at least 0.1 μm, and there was negligible additional effect at an increased thickness. However, in the case that the oxide film is thicker than 0.3 μm, when a post treatment such as coating with a chromate film or a coating with a Cr-free film is performed on the coating layer, there is a possibility that the characteristics of the film obtained by the post treatment may be changed, which is not preferable.

When nitrogen wiping is performed at the time of hot dip coating, the molten coating solution is uniformly removed and an extremely thin oxide film being 0.1 μm thick or less is formed. In addition, once the oxide film is formed, the thickness of the oxide film does not significantly increase even after a lapse of time according to a conventional hot-dip coating method.

Therefore, the present invention proposes a method that prevents the occurrence of linear stripe defects. Specifically, according to the method, after performing nitrogen wiping to remove the excess molten coating solution attached to the surface of the steel sheet, the oxide film is made to be 0.1 μm to 0.3 μm thick before the coating layer starts to solidify.

According to the hot dip galvanizing method of the present invention in which a steel sheet immersed in a conventional Zn—Al—Mg-based galvanizing bath containing 1 wt % to 5 wt % of Mg and 1 wt % to 17 wt % of Al is removed from the plating pot, the coating amount is adjusted by nitrogen wiping to prevent wave patterned defects, and the steel sheet is cooled to a temperature of 300° C. or less while passing the top roll, oxidizing of the coating surface is required to be started at a steel sheet temperature of 385° C. or higher and terminated at a temperature of 380° C. or higher in order to perform the oxidation before the coating layer is solidified after nitrogen wiping.

When the coating layer is solidified by cooling after wiping, although varying depending on composition of the coating layer, two or three or more phases among Zn single phase, Zn—Al binary eutectic, $MgZn_2$ single phase, Zn—$MgZn_2$ binary eutectic phase, and Zn—$MgZn_2$—Al ternary eutectic phase may be formed in a mixed manner. The solidification starts at a minimum of 380° C., and the solidification is terminated when Zn—$MgZn_2$—Al ternary eutectic phase is formed at around 340° C. In particular, Mg in the coating layer exists in the form of intermetallic compounds of $MgZn_2$ or $Mg_2Zn_{11}$ and starts to be formed mainly at 380° C.

According to an experiment carried out by the present inventors, it was confirmed that the surface oxidation of the coating layer is effective when the surface oxidation starts immediately after the nitrogen wiping and terminates before the coating layer starts to solidify. More precisely, the surface oxidation of the coating layer is required to be terminated before the intermetallic compound of Mg is formed. When the oxidation starts at 385° C. or below, a primary solidification phase may in progress and thus the effect of the oxidation is not sufficient. $MgZn_2$ or $Mg_2Zn_{11}$ starts to be formed when the oxidation is carried out to a temperature of 380° C. or below. Therefore, oxidation of these intermetallic compound particles may occur, and thus black spots may appear.

Generally, in the molten coating layer containing Al and Mg, the solidification initiation temperature varies depending on the composition. Therefore, it is safer to start the oxidation at a steel sheet temperature of about 410° C. after nitrogen wiping.

In order to form the coating layer to be at least 0.1 μm to 0.3 μm thick, the present invention proposes a method in which the steel sheet passes through a chamber where ozone concentration is controlled.

Ozone is contained in the atmosphere at about 0.4 ppm and is known as a strong oxidizing agent.

When ozone concentration was less than 1 ppm, there is no oxidation effect by ozone, so an oxide film having a thickness of less than 0.1 μm was formed. In this case, linear defects occur. At or above 100 ppm, there is no effect on the product quality, but there is a risk that the ozone concentration around the equipment increases and the work environment deteriorates due to high concentration of ozone. In addition, the oxide film becomes 30 μm thick or more, which may change the post treatment characteristics.

Therefore, the ozone concentration is preferably 1 ppm to 100 ppm.

As a method of controlling ozone in the air cooling the steel sheet within the range of 1 ppm to 100 ppm, using a corona discharge ozone generator is most convenient way. For plate-formed steel sheets, wire-type corona discharge electrodes are preferably used to obtain uniform ozone concentration in the width direction. Particularly in this case, ozone generated by a corona discharge is moved to the steel sheet by electric force so that the surface of the coating layer can be more uniformly and effectively oxidized. A value of the high voltage for generating a corona discharge is determined by the thickness of wires and the fine surface roughness of wire surfaces. In the case that a large number of tungsten wires having thicknesses of about 0.2 μm to 0.3 μm are installed in the width direction of the steel sheet, a high voltage of −10 kV or higher is required to generate a corona discharge, and it is possible to control the ozone concentration within the range proposed in the present invention by adjusting the intensity of the high voltage.

With respect to the generation of ozone, oxygen may be supplied in addition to air to increase the oxygen concentration in the cooling air, which may be more effective in generating ozone.

In addition, it is possible to cool the steel sheet faster by installing nozzles on the rear side of the tungsten wires that draws air cooling the steel sheet, and by allowing the air sprayed from the nozzle to pass across the tungsten wires.

In addition, as a method of oxidizing a coating surface, spraying an aqueous solution containing 0.01% to 1% of hydrogen peroxide toward the steel sheet starts when the steel sheet temperature is 385° C. or higher and terminates at a temperature of 380° C. or higher such that it is possible to prevent the occurrence of linear defects. When the sprayed aqueous solution comes into contact with the surface of the steel sheet, hydrogen peroxide in the solution acts as an oxidizing agent and promotes oxidation of the surface of the coating layer. When the concentration of hydrogen peroxide is less than 0.01%, the concentration is too low and the effect of preventing linear defects is insufficient. When the concentration of hydrogen peroxide is more than 1%, the oxidation of the surface of the coating layer occurs to a great extent whereby the thickness of the oxide film is excessively increased and thus the post treatment characteristics may be changed.

It is also possible to oxidize the coating layer by spraying both the ozone-containing cooling air and the hydrogen peroxide-containing aqueous solution proposed in the present invention to the steel sheet.

In addition, when the oxidation is performed for 0.5 seconds to 1.5 seconds, the oxide film having the thickness proposed in the present invention can be obtained. Even when the oxidation is performed for 1.5 seconds or more, the thickness of the oxide film is generally constant without being increased. It is preferable to perform the oxidation for one second. In a galvanizing plant continuously manufacturing galvanized steel sheets, the length of an oxidation treatment tank is required to be long to increase the oxidation time, which is costly to install. Therefore, when an oxidation tank having a length corresponding to about 1 second of the oxidation time at the maximum speed is provided, it is possible to manufacture galvanized steel sheets without linear defects.

Hereinbelow, the present invention will be described in detail with reference to embodiments.

Embodiment 1

A steel sheet with a thickness of 0.7 mm was immersed in a plating pot filled with a galvanizing bath containing Mg, Al, and the balance of Zn at a temperature of 450° C. The steel sheet was removed from the plating pot. Total coating amount attached to surfaces of the steel sheet was adjusted to 120 g/m$^2$ by nitrogen wiping, and then an oxide film was formed.

Table 1 shows an example of surface oxidation performed by passing the steel sheet through a chamber in which ozone concentration was controlled. To change the ozone concentration, tungsten wires with a diameter of 0.3 mm thick were disposed in parallel to each other in the width direction to face the steel sheet. A high voltage generated from a high voltage generator connected to the tungsten wires was applied to the tungsten wires to cause a corona discharge, and thus ozone was generated. At this time, the generated ozone was moved to the steel sheet by electric force and oxidized the surfaces of the coating layer in the molten state attached to the steel sheet. The ozone concentration was adjusted by controlling a value of applied high voltage. The ozone concentration was measured with an ozone meter generally used. FIG. 7 is a graph of an example of measuring the ozone concentration in the chamber depending on the value of high voltage. At −10 kV, there was no ozone generation because there was no corona discharge. However, when the high voltage was increased to a level of higher than −10 kV, the ozone concentration gradually increased. Then, the ozone concentration was rapidly increased at −20 kV or more, and 120 ppm of ozone was generated at −26 kV. In this embodiment, oxidizing of the coating surface was performed by varying the high voltage value according to the example of FIG. 7 and adjusting the ozone concentration.

The surface of the solidified coating layer after oxidation was observed to evaluate occurrence of linear defects. "○" is a state in which no linear defect is present, "Δ" is a state in which fine linear defects are present, and "X" is a state in which linear defects are observed clearly. A pyrometer was used to measure the temperature of the steel sheet in oxidation.

In order to measure the oxide film thickness of the coating layer, oxygen concentration in the depth direction of the coating layer was analyzed by a glow discharge mass spectrometer. FIG. 6 is a graph of an example in which the coating thickness was converted from the obtained value of oxygen concentration in the depth direction of the coating layer. That is, as illustrated in FIG. 6, two trend lines were drawn based on an inflection point of an oxygen concentration measurement curve, and points where the trend lines meet were defined as oxide film thickness on the coating surface.

In order to confirm the occurrence of black spots on the surface of the coating surface, galvanized specimens were stored for seven days under a condition of humidity of 85% and temperature of 85° C., and then it was determined whether black spots were formed on the surface. "○" is a state in which no black spot was present, and "X" is a state in which black spots were present.

TABLE 1

| Category | Composition of galvanizing bath (wt %) | | | Oxidation temperature (° C.) | | Ozone concentration | Oxide film thickness | Linear | Black surface |
|---|---|---|---|---|---|---|---|---|---|
| | Mg | Al | Zn | Start | Finish | (ppm) | (μm) | defects | spots on |
| Comparative Example 1 | 1.5 | 1.5 | Balance | 410 | 385 | 0.4 | 0.07 | X | ○ |
| Comparative Example 2 | 1.5 | 1.5 | Balance | 410 | 385 | 0.5 | 0.09 | Δ | ○ |
| Comparative Example 3 | 1.5 | 1.5 | Balance | 383 | 380 | 100 | 0.06 | X | ○ |
| Comparative Example 4 | 4 | 17 | Balance | 410 | 370 | 100 | 0.35 | ○ | X |
| Comparative Example 5 | 3 | 3 | Balance | 380 | 365 | 50 | 0.06 | X | X |
| Example 1 | 1.5 | 1.5 | Balance | 410 | 385 | 1 | 0.12 | ○ | ○ |
| Example 2 | 1.5 | 1.5 | Balance | 385 | 380 | 100 | 0.3 | ○ | ○ |
| Example 3 | 4 | 17 | Balance | 410 | 400 | 40 | 0.2 | ○ | ○ |
| Example 4 | 3.0 | 3.0 | Balance | 405 | 390 | 50 | 0.25 | ○ | ○ |

The results will be described with reference to Table 1.

Comparative Example 1 was not applied with high voltage. The ozone concentration in the chamber was as low as 0.4 ppm, the oxide film was as thin as 0.07 μm thick, and linear defects were observed.

Comparative Example 2 was cooled within the temperature range proposed in the present invention. The ozone concentration was as low as 0.5 ppm, the oxide film was 0.09 μm, and linear defects were faintly visible.

Comparative Example 3 was a case where the oxidation started at a temperature of 383° C. lower than the temperature proposed in the present invention. Although the ozone concentration was as high as 100 ppm, the oxide film was as thin as 0.06 thick μm and had a bad surface quality where linear defects were clearly visible.

Comparative Example 4 was a case where the oxidation started at a temperature of 410° C. satisfying the temperature proposed in the present invention but the oxidation terminated at a temperature as low as 370° C. The oxide film was 0.35 μm thick, and no linear defect was present. However, a large number of black spots were observed in a humidity test. It is presumed that the black spots were generated by oxidation of Mg intermetallic compounds.

Comparative Example 5 was a case where the oxidation started at a temperature as low as 380° C. and terminated at a temperature as low as 365° C. The oxide film was 0.06 μm thick, linear defects were clearly visible, and black spots were observed in a humidity test.

Example 1 was a case where the cooling was started at a temperature of 410° C. and terminated at a temperature of 385° C. under a condition of the ozone concentration of 1 ppm. The oxide film was 0.12 μm thick. There was no linear defect and no black spot so that the surface quality was excellent.

Example 2 was a case where the cooling was started at a temperature of 385° C. and terminated at a temperature of 380° C. under a condition of the ozone concentration of 100 ppm. The oxide film was 0.3 μm thick. There was no linear defect and no black spot so that the surface quality was excellent.

Example 3 was a case where the cooling was started at a temperature of 410° C. and terminated at a temperature of 400° C. under a condition of the ozone concentration of 40 ppm. The oxide film was 0.2 μm thick. There was no linear defect and no black spot so that the surface quality was excellent.

Example 4 was a case where the cooling was started at a temperature of 405° C. and terminated at a temperature of 390° C. under a condition of the ozone concentration of 50 ppm. The oxide film was 0.25 μm thick. There was no linear defect and no black spot so that the surface quality was excellent.

It was confirmed from the results in Table 1 that when the coating surface oxidation, in which the steel sheet passes through the chamber in which the ozone concentration was controlled to be 1 ppm or higher and 100 ppm or below, started at a temperature of 385° C. or higher and terminated at a temperature of 380° C. or higher, an oxide film having a thickness of 0.1 μm to 0.3 μm proposed in the present invention was formed on the surface. Thus, the coating with an aesthetic appearance was obtained without linear defect, and it was confirmed that the thickness of the oxide film is mainly affected by the ozone concentration.

Embodiment 2

A steel sheet with a thickness of 0.7 mm was immersed in a plating pot filled with a galvanizing bath containing Mg, Al, and the balance of Zn at a temperature of 450° C. The steel sheet was removed from the plating pot. Total coating amount attached to surfaces of the steel sheet was adjusted to 120 g/m$^2$ by nitrogen wiping, and then an oxide film was formed. Then, surface oxidization of a coating layer was performed in which an aqueous solution containing hydrogen peroxide was sprayed on the surfaces of the steel sheet removed from the plating pot, and the steel sheet was cooled.

Table 2 shows how much linear defects were present through observation of oxide film thickness and the surface of the solidified steel sheet were observed. A two-fluid spray nozzle spraying air and the solution together was used as a solution spraying manner. A spray pressure was 3 kg/cm$^2$ for the air and 2 kg/cm$^2$ for the solution.

TABLE 2

| Category | Composition of galvanizing bath (wt %) | | | Oxidation temperature (° C.) | | $H_2O_2$ concentration | Oxide film thickness | Linear | Black spots on |
|---|---|---|---|---|---|---|---|---|---|
| | Mg | Al | Zn | Start | Finish | (ppm) | (μm) | defects | surface |
| Comparative Example 6 | 1.5 | 1.5 | Balance | 410 | 385 | 0 | 0.07 | X | ○ |
| Comparative Example 7 | 1.5 | 1.5 | Balance | 410 | 385 | 0.05 | 0.09 | Δ | ○ |
| Comparative Example 8 | 1.5 | 1.5 | Balance | 383 | 380 | 0.1 | 0.08 | Δ | ○ |
| Comparative Example 9 | 4 | 17 | Balance | 410 | 370 | 0.1 | 0.3 | ○ | X |
| Comparative Example 10 Note 1) | 3 | 3 | Balance | 410 | 385 | 1.2 | 0.4 | ○ | ○ |
| Example 5 | 1.5 | 1.5 | Balance | 410 | 385 | 0.1 | 0.12 | ○ | ○ |
| Example 6 | 1.5 | 1.5 | Balance | 385 | 380 | 1 | 0.3 | ○ | ○ |
| Example 7 | 4 | 17 | Balance | 410 | 400 | 0.3 | 0.18 | ○ | ○ |
| Example 8 | 3.0 | 3.0 | Balance | 405 | 390 | 0.6 | 0.24 | ○ | ○ |

Note 1) When the galvanized steel sheet was chromated, the wettability between a chrome solution and the coating surface was poor, and thus the Cr film was in poor condition.

The results will be described with reference to Table 2.

Comparative Example 6 was cooled within the temperature range proposed in the present invention by blowing air. The hydrogen peroxide concentration was 0%, which means hydrogen peroxide was not added. The oxide film was as thin as 0.07 μm thick, and linear defects were visible.

Comparative Example 7 was cooled within the temperature range proposed in the present invention. The hydrogen peroxide concentration was as low as 0.05 ppm, the oxide film was 0.09 μm thick, and linear defects were faintly visible.

Comparative Example 8 was a case where the oxidation started using a solution containing 0.1% hydrogen peroxide at a temperature of 383° C. lower than the temperature proposed in the present invention. The oxide film was 0.08 μm thick and had surface quality where linear defects were faintly visible.

Comparative Example 9 was a case where the oxidation started using a solution containing 1% hydrogen peroxide at a temperature of 410° C. and terminated at a temperature as low as 370° C. The oxide film was 0.3 mm thick, and no linear defect was present. However, a large number of black spots were observed in a humidity test. It is presumed that the black spots were generated by oxidation of Mg intermetallic compounds.

Comparative Example 10 was a case where the oxidation started using a solution containing 1.2% hydrogen peroxide at a temperature of 410° C. and terminated at a temperature as low as 385° C. The oxide film was 0.4 mm thick. Although there was no linear defect and no black spot, the wettability between the chrome solution and the surface of the coating layer was poor when the steel sheet was chromated. Thus, a problem was observed in which the Cr film was unevenly formed.

Example 5 was a case where the cooling was started using a solution containing 0.1% hydrogen peroxide at a temperature of 410° C. and terminated at a temperature of 385° C. The oxide film was 0.12 μm thick. There was no linear defect and no black spot so that the surface quality was excellent.

Example 6 was a case where the cooling was started using a solution containing 1% hydrogen peroxide at a temperature of 385° C. and terminated at a temperature of 380° C. The oxide film was 0.3 μm thick. There was no linear defect and no black spot so that the surface quality was excellent.

Example 7 was a case where the cooling was started using a solution containing 0.3% hydrogen peroxide at a temperature of 410° C. and terminated at a temperature of 400° C. The oxide film was 0.18 μm thick. There was no linear defect and no black spot so that the surface quality was excellent.

Example 8 was a case where the cooling was started using a solution containing 0.6% hydrogen peroxide at a temperature of 405° C. and terminated at a temperature of 390° C. The oxide film was 0.24 μm thick. There was no linear defect and no black spot so that the surface quality was excellent.

It was confirmed from the results of Table 2 that when spraying of the solution containing hydrogen peroxide concentration of 0.1% to 1% started at a temperature of 385° C. or higher and terminated at a temperature of 380° C. or higher, an oxide film having a thickness of 0.1 μm to 0.3 μm proposed in the present invention was formed on the surface. Thus, the coating with an aesthetic appearance was obtained without linear defect, and it was confirmed that the thickness of the oxide film is mainly affected by the hydrogen peroxide concentration.

What is claimed is:

1. A method of manufacturing a hot dipped galvanized steel sheet containing Mg, the method comprising:

adjusting a coating amount by an air knife after a steel sheet is immersed in and removed from a galvanizing bath of a plating pot to form a galvanized steel sheet by passing a sink roll;

forming an oxide film by oxidizing the galvanized steel sheet air-cooling the galvanized steel sheet having the oxide film; and passing the galvanized steel sheet over a top roll after the air-cooling;

wherein the forming of the oxide film is performed by using a corona discharge ozone generator.

2. The method of claim 1, wherein the forming of the oxide film is performed by using an ozone generator spraying an aqueous solution containing hydrogen peroxide.

3. The method of claim 2, wherein the aqueous solution contains 0.01% to 1% hydrogen peroxide.

4. The method of claim 2, wherein the forming of the oxide film is performed for 0.5 seconds to 1.5 seconds in a chamber, wherein the steel sheet is inserted in the chamber at a temperature from 385° C. to 410° C. and the steel sheet is taken out from the chamber at a temperature from 380° C. to 400° C., and wherein an ozone concentration in the chamber is 1 ppm to 100 ppm.

5. The method of claim 1, wherein the forming of the oxide film is performed for 0.5 seconds to 1.5 seconds in a chamber, wherein the steel sheet is inserted in the chamber at a temperature from 385° C. to 410° C. and the steel sheet is taken out from the chamber at a temperature from 380° C. to 400° C., and wherein an ozone concentration in the chamber is 1 ppm to 100 ppm.

6. The method of claim 1, wherein the oxide film is 0.1 μm to 0.3 μm thick.

7. The method of claim 1, wherein the forming of the oxide film is performed for 0.5 seconds to 1.5 seconds in a chamber, wherein the steel sheet is inserted in the chamber at a temperature from 385° C. to 410° C. and the steel sheet is taken out from the chamber at a temperature from 380° C. to 400° C., and wherein an ozone concentration in the chamber is 1 ppm to 100 ppm.

* * * * *